US005903947A

United States Patent [19]

Sullivan

[11] Patent Number: 5,903,947

[45] Date of Patent: May 18, 1999

[54] RESTAURANT SINK CLEANING TOOL

[76] Inventor: Patrick Colin Sullivan, P. O. Box 842, Eugene, Oreg. 97440

[21] Appl. No.: 09/067,540

[22] Filed: Apr. 27, 1998

Related U.S. Application Data

[ 60] Provisional application No. 60/044,458, Apr. 28, 1997.

[51] Int. Cl.[6] ..... A47L 13/11

[52] U.S. Cl. ..... 15/105; 15/236.01; 15/245; 210/470; 210/498

[58] Field of Search ..... 15/105, 236.01, 15/245; 210/470, 498

[56] References Cited

U.S. PATENT DOCUMENTS

| | | | |
|---|---|---|---|
| 256,325 | 4/1882 | Johntry . | |
| 388,880 | 9/1888 | Kirkland . | |
| 1,367,032 | 2/1921 | Ferdon | 15/236.01 |
| 1,903,277 | 4/1933 | Barnes | 15/245 |
| 3,013,291 | 12/1961 | Matrick | 15/245 |
| 5,272,786 | 12/1993 | Edström | 15/236.01 |

*Primary Examiner*—Randall E. Chin

[57] ABSTRACT

A restaurant and residential tool for cleaning debris from kitchen sinks and table tops by scraping and straining. The tool includes a rectangular or square shape with more than a thousand holes. On one side is formed a handle, perpendicular to the handle are two perforated sides raised half an inch. Opposite the handle is attached a flat piece of rubber. The rubber is sandwiched between two securing strips of metal fastened with nuts and bolts. Possible materials used include non rusting stainless steel, aluminum, durable rubber and plastic. The rubber material is non marking, durable and chemical and heat resistant. The multitude of holes allow water to drain quickly during use. The rigid nature of this tool provides stability during lifting of sink refuse. The tool is used for the following: safely remove and clean refuse and broken glass from various sized sinks, squeegee work table tops, clean grease traps and ice from salad bars.

1 Claim, 3 Drawing Sheets

RESTAURANT SINK CLEANING TOOL

This application claims the benefit of U.S. Provisional Appln. No. 60/044,458, filed Apr. 28, 1997.

BACKGROUND—FIELD OF INVENTION

This invention relates to a restaurant sink cleaning tool for expediently and safely scraping and straining kitchen sinks of food refuse or broken glass.

Figure 1:
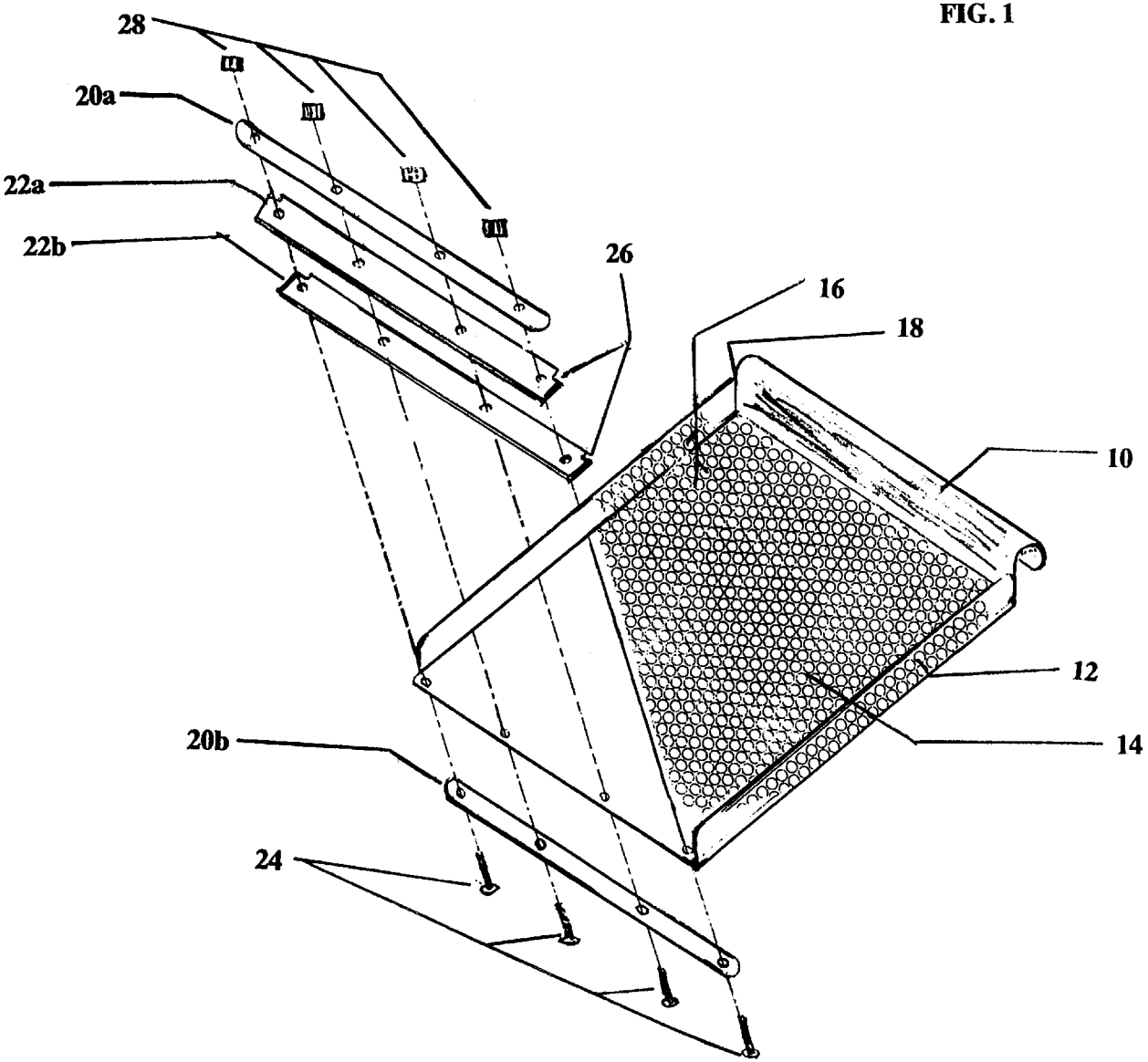
FIG. 1 shows sink cleaning tools from an angle displaying top and side aspects and an exploded view of rubber with securing attachments.

| Reference Numerals in Drawings | |
|---|---|
| 10 handle | 12 raised sides of tool |
| 14 main body of tool | 16 perforated holes |
| 18 joint of handle and sides | |
| 20a & 20b securing strips of stainless steel for rubber | |
| 22a 2.54 centimeters wide attached rubber | |
| 22b 3.175 centimeters wide attached rubber | |
| 24 bolts used to secure rubber | 26 cut corners of rubber |
| 28 lock nuts | |

SUMMARY OF THE INVENTION

The invention described relates to a sink scraping tool. More specifically, the invention is a perforated sink cleaning tool with a squeegee edge. The tool includes a rigid, flat, rectangular body, a handle at one end, and a squeegee edge at the opposite end. The squeegee edge serves to scrape surfaces. The tool collects a slurry of waste from a sink or other container. Perforation in the body of the tool permit fluids to drain from the slurry while retaining solids.

DETAILED DESCRIPTION OF THE PREFERRED EMBODIMENT

FIG. 1 shows a top view, side perspective, and an exploded view of rubber with securing attachments for the main body 14 of the sink cleaning tool. This commercial restaurant sink cleaning tool is made from a non-rusting solid sheet of eighteen gauge stainless steel. A one square foot piece of stainless steel is cut from a larger solid sheet. The cut piece of stainless steel is machine cut in a pattern with more than one thousand four-hundred 0.47625 centimeter holes 16. The patterned piece of stainless steel is then sanded to remove any sharp burrs and edges.

Figure 2:
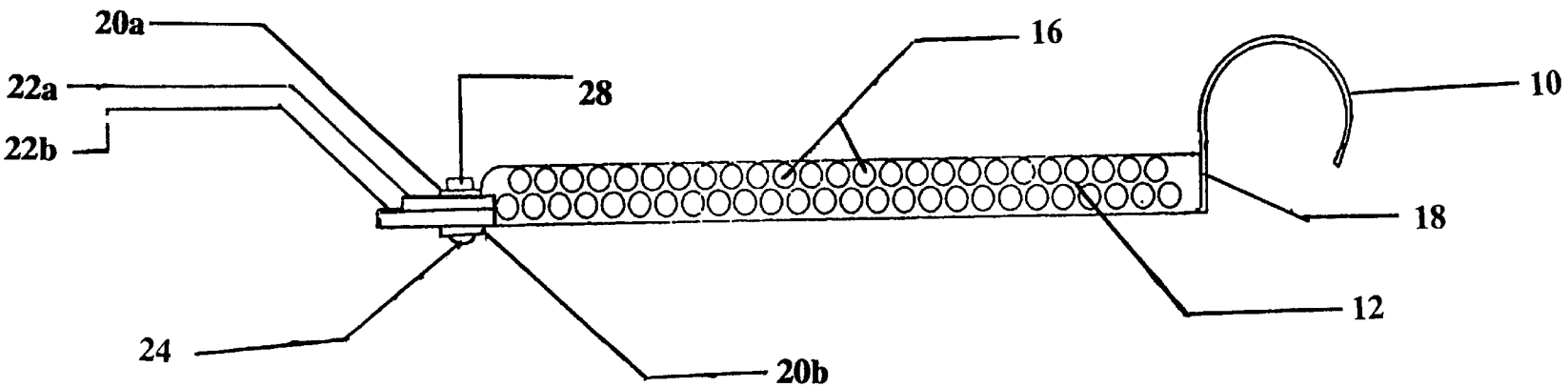
FIG. 2 is a side view showing the raised side and side view of handle and rubber attachment.

A large press is used to form a handle 10 out of the patterned piece of stainless steel. The handle 10 is made of solid stainless steel. The handle 10 is formed into a 2.54 centimeter diameter three quarter circle. This circular shape of the handle 10 shown in FIG. 2 provides a comfortable grip for the user. The gap on the underside of the handle 10 prevents water from catching in the tool while in use.

A side 12 is bent up on each side of the tool to fit next to a handle/side joint 18 as can be seen in FIG. 1 and FIG. 2. The sides 12 rise 1.27 centimeters above the main body 14 to create a barrier to help collect food into the main body 14.

The sides 12 have two rows of 0.47625 centimeters perforated holes to allow water to pass quickly.

A main body 14 and sides 12 of this sink cleaning tool have more than one thousand four-hundred 0.47625 centimeters perforated holes 16. The large number of holes 16 allow water to drain quickly and dramatically reduces resistance while being moved through water. The eighteen gauge stainless steel provides a strong rigid structure for the main body 14 even with the numerous perforated holes 16.

Figure 3:
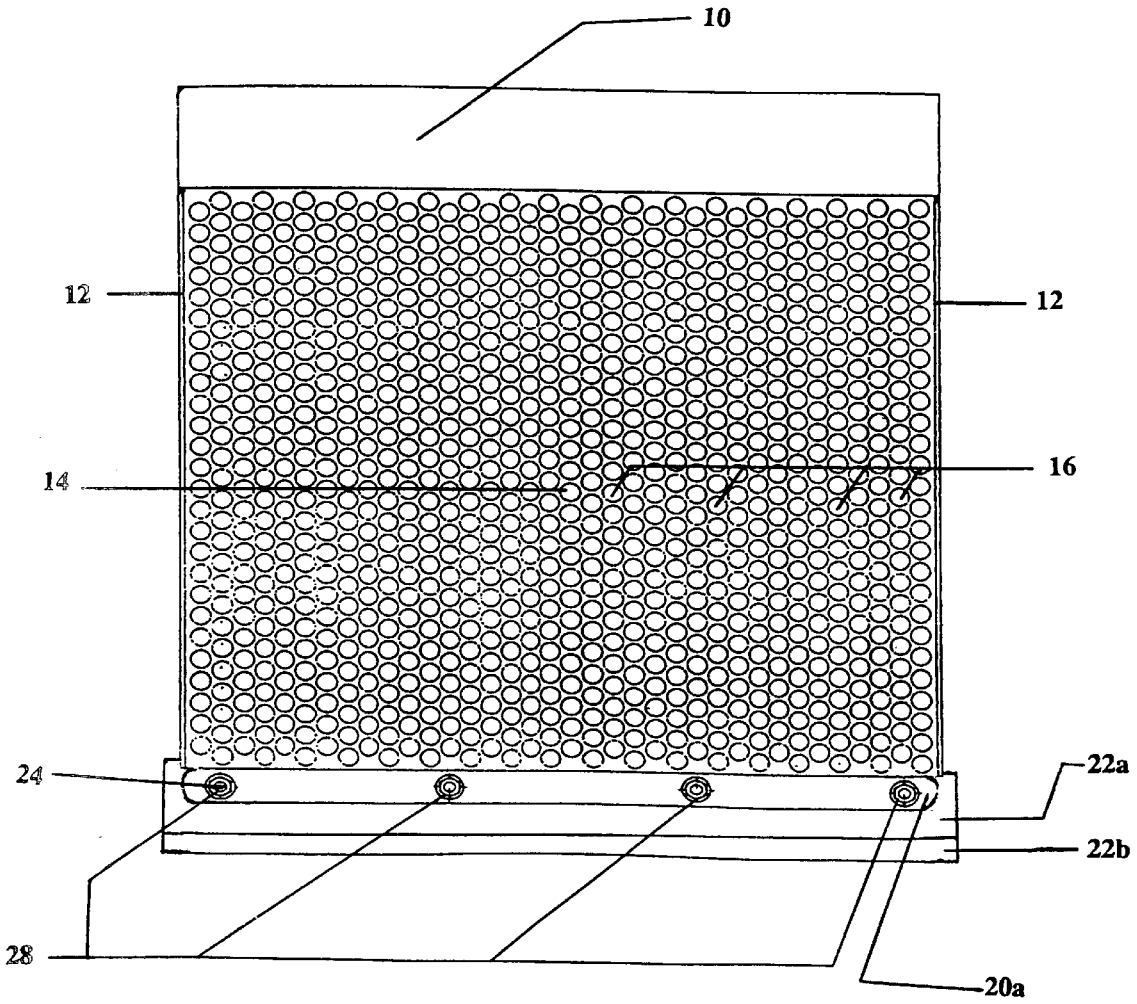
FIG. 3 shows top view with a handle, body of sink cleaning tool and the attached rubber end.

FIG. 1 shows how two pieces of rubber are attached to the main body 14 of the tool. The rubber acts as a squeegee to scrape the bottom surface and sides of sinks, as well as counter tops. A rubber piece 22*a* is 2.54 centimeters wide and 25.876 centimeters long. A rubber piece 22*b* is 3.016 centimeters wide and 25.876 centimeters long. The different widths as shown in FIG. 2 and FIG. 3 enable the rubber pieces greater ease of movement, flexibility and conformity to accommodate the concavity of the bottom of the sinks. The rubber pieces 22*a* and 22*b* are cut 0.15875 centimeters longer on each side of the main body 14 to facilitate better access to sink corners. A notch 26 shown in FIG. 1 is placed in the corner of the rubber. The notch is used to allow the rubber to fit on the outside of the main body's 14 sides 12 as shown in FIG. 2 and FIG.3

Each piece of rubber used for this tool is 0.15875 centimeters thick. A machine is used to cut a 2.5 centimeter wide strip and a 3.016 centimeter wide strip. The durometer of the rubber is between 65 and 75. This type of rubber is non-marking, chemical resistance, and durable.

The attachment shown with an exploded view in FIG. 1 shows how the rubber 22*a* and 22*b* are fastened to the main body 14 of the tool. A securing plate 20*a* and a securing plate 20*b* are made from stainless steel hold the rubber to the main body 14. One securing plate 20*a* is placed on the bottom of the main body 14 at the opposite end from the handle. Four holes are punched in 20*a* and 20*b* securing plates by a perforation machine. These holes are lined up with the main body 14 of the tool. The securing plates 20*a* and 20*b* are an identical size of 24.765 centimeters long. The securing plates add strength and stability to the rubber pieces 22*a* and 22*b*.

A stainless steel 1.5875 centimeter long bolt 24 is used to secure the rubber 22*a* and 22*b* to the main body 14. Four evenly spaced bolts 24 are inserted up through securing plate 20*a* in from the bottom of the main body 14 on the end opposite the handle 10.

Holes are punched into the rubber to accommodate the bolts 24. The bolts 24 are used to secure the rubber to the main body 14. A lock nut 28 is tightened on each bolt 24 to secure the rubber to the main body 14 of the cleaning tool. A lock nut 28 is used to prevent nuts and bolts from coming apart and allow for easy replacement of rubber. The lock nuts 28 and the bolts 24 are made from non-rusting stainless steel.

FIG. 2 provides a side perspective of: handle 10, side 12 and bolt head 24, lock nut 28, and rubber 22*a* and 22*b*. The side 12 rises 1.27 centimeters above the handle 10. The sides 12 are connected to the main body 14 of the tool. The sides start at the side/handle joint 18 until the sides 12 touch the rubber attachment pieces 22*a* and 22*b* as shown in FIG. 2 and FIG. 3. The strength and rigid nature of eighteen gauge stainless steel gives this cleaning tool a sturdy unbending form. The rigid nature of this tool is necessary for strength and consistency of form while the tool is holding and gathering food refuse from the sink.

OPERATION—FIGS. 1,2,3.

FIG. 1 shows the top perspective of the restaurant sink cleaning tool. The tool is made with high quality non-rusting stainless steel. Stainless steel is widely used in restaurants because of these hygienic traits. The eighteen gauge stainless steel is strong and rigid. The cleaning tool is gripped by the handle 10 in either hand to operate. To hold the tool place the thumb over the top of the handle 10. The fingers are placed on the bottom of the tool for support. The fingers can also be placed on the inside of the handle 10. Food refuse is strained from the water when this tool moves through the sink. This sink cleaning tool works best when moved from sinks'outer edges and bottom upward through the water. The attached rubber squeegee allows this cleaning tool to move with ease on the metal surface of the sink. After several glides through the food refuse in the sink is cleared out of the sink. Food refuse collected from a sink is emptied into a garbage container.

A major benefit of this tool is cleaning food refuse from sinks. This sink cleaning tool is made with more than one thousand four hundred perforated holes. The numerous perforated holes 16 in the tool speeds movement through water of a clogged sink. When the food refuse is cleaned from the sink, water can easily be drained. A large sink filled with food refuse and water can take up to twenty minutes to clean out. With this sink cleaning tool a sink can be cleaned of food refuse in about one minute.

The rigid nature of the tool allows food refuse to be picked up and out of the sink without spilling over the edge of the tool as may happen with a flexible tool. The shape of the tool conforms to the large square sinks found in most restaurants. This shape allows food to be cleared from the sink in an expedient manner. This tool is made from stainless steel allowing easy entrance to the water.

The squeegee attached to this tool as illustrated in FIGS. 2 and 3 allow the user of the tool to scrape along the bottom and sides of a sink thereby scraping all food refuse from the bottom of the sink. This tool also works as a squeegee for scraping water and food from table tops throughout the kitchen.

This sink cleaning tool shown in FIGS. 1 to 3 can be made slightly smaller or larger. This tool can be made out of a strong durable unbending plastic compound. The perforated holes could also be made smaller. This tool can be used in any commercial size sink. A smaller version of this tool could also be used in the residential households.

I claim:

1. A restaurant kitchen sink cleaning tool for scraping food and debris from sinks and cleaning counter tops comprising:

a flat plate body of rigid material of substantially rectangular shape having a front surface, a rear surface opposed to said front surface, said plate body also having first, second, third and fourth sides, said first side including a handle, said second and third sides including a bend in said plate body rising above said plate body on left and right sides of said handle and said fourth side having a rubber squeegee attached thereto opposite said handle;

said handle extending along the length of said first side and extending back forming a half circle for ease in gripping, said handle fitting between a thumb and a pointing finger;

said bends on said second and third sides extending out from the handle to said rubber squeegee opposite said handle;

said plate body and said bends including a multitude of holes;

said bends of said plate body serving to increase the rigidity of said tool and serve as barriers to hold in refuse while gathering food from a kitchen sink.

* * * * *